US005873420A

United States Patent [19]

Gearhart

[11] Patent Number: 5,873,420

[45] Date of Patent: Feb. 23, 1999

[54] AIR AND MUD CONTROL SYSTEM FOR UNDERBALANCED DRILLING

[76] Inventor: Marvin Gearhart, P.O. Box 40540, Forth Worth, Tex. 76140

[21] Appl. No.: 864,012

[22] Filed: May 27, 1997

[51] Int. Cl.[6] ..... E21B 21/00

[52] U.S. Cl. ..... 175/25; 175/69

[58] Field of Search ..... 175/25, 38, 48, 175/50, 69, 70, 205

[56] References Cited

U.S. PATENT DOCUMENTS 1,346,939 7/1920 Carmichael ..... 175/69
2,726,063 12/1955 Ragland et al. ..... 175/69
3,497,020 2/1970 Kammerer, Jr. ..... 175/69
3,534,822 10/1970 Campbell et al. ..... 175/205
3,827,511 8/1974 Jones ..... 175/25

*Primary Examiner*—William Neuder
*Attorney, Agent, or Firm*—Gunn & Associates, P.C.

[57] ABSTRACT

A method and apparatus for drilling a well is set forth. In one aspect, a typical drill stem is assembled from a set of drill pipe and delivers a flow of drilling mud to the drill bit. A smaller tubing string is placed on the interior and connects to a mixing valve just above the drill bit. A gas flow is placed in the tubing which flows to the mixing valve where the gas is mixed in a desired ratio with the drilling mud so the mud weight is reduced, and thereby enables drilling, at a faster rate with an underbalanced condition. Steps are set forth in which the pressure is changed to an overbalanced condition.

36 Claims, 3 Drawing Sheets

AIR AND MUD CONTROL SYSTEM FOR UNDERBALANCED DRILLING

BACKGROUND OF THE DISCLOSURE

1. Field of the Invention

The present disclosure is directed toward a multiphase drilling system and one which attains an underbalance in system pressure. More specifically, in drilling an oil well, the most popular approach is drilling the well with a drill bit affixed to the end of a string of drill pipe which is used to pump down drilling mud circulating through the drill bit at the end of the pipe where the mud is returned to the surface on the exterior of the drill pipe flowing upwardly in the annular space on the outside of the drill pipe. The mud is kept at a specific weight, typically measured in pounds per gallon, so the weight of the column of mud in the partially drilled well is equal to and preferably greater than the pressure that would prevail in the formations as the well is drilled to deeper depths.

2. Background of the Art

There is a preexistent pressure on the formations of the earth which, in general, increases as a function of depth due to the weight of the overburden on a particular strata. Intuitively, this weight increases with depth so the prevailing or quiescent bottom hole pressure is increased in a linear fashion with respect to depth. Thus, as the well depth is doubled. the pressure is likewise doubled. There are, however, some formations which have a fluid drive which is at a higher pressure. When a drill string or "drill stem" penetrates such a formation, fluid may flow in the formation toward the open hole and flow into the annular space, thereby venting and changing the mud pressure balance. This is especially true when a formation is entered where there is a relatively high pressure fluid drive and the formation also includes a significant portion of natural gas. The gas may readily flow out of the formation into the well borehole and bubble upwardly. The formation may produce natural gas in such volumes that the standing column of drilling fluid which maintains bottom hole pressure equal to or greater than the pressure at that depth may be significantly reduced. So to speak, the column of drilling mud is foamed and can become so light that a blowout occurs.

Blowouts are a threat to drilling operations, and especially create significant risk to personnel. Since the well borehole may puncture a formation, perhaps at an expected location or perhaps in an unexpected fashion, it is possible for a significant unexpected flow of natural gas to be encountered. In the past, the first warning on the rig floor at the surface has been a threatening reduction in mud weight. That, however, is difficult to visually inspect at the surface. Even worse, in catastrophic circumstances, the first warning at the rig floor is that the gas flow released from the confined formation punctured by the well borehole is sufficient to lift the drill string. In the worst occasion, the drill pipe has actually been blown back out of the partly completed well. The gas cut mud is blown up through the annulus, forced from the well, and gas begins to flow without limit.

Protection has been obtained, with some success but with occasional failures by installing a blowout preventer (BOP hereinafter) at the rig floor. Indeed, safety demands BOP installation and it is mandatory that a BOP is installed. They, however, do not always work in sufficient time to maintain and keep control over a blowout.

One approach used heretofore has been to drill the well using drilling mud which provides an overbalance in pressure at the bottom of the partly complete well borehole. An overbalanced is attained by increasing the density of the drilling fluid. If only water were used, the specific density would be minimal. The weight is increased by adding weight materials which are typically clay products. The density can be raised significantly by adding the weight materials to the drilling mud. That provides a substantial measure of safety because the weight of the mud can be increased so much that overbalancing of the bottom hole pressure is always a prevailing fact.

The column of drilling mud in the annual space is increased in weight until the weight is so high there is no risk. One detrimental aspect to this is, as the weight is increased, the rate of penetration of the drill bit is decreased. The drill bit operates by rotating cutting teeth jammed against the bottom face of the partly completed well borehole. They tend to fracture pieces of the formation then being drilled. The formation, however, is held in place by the column of drilling mud. If the column of mud were omitted, the formation would more readily fracture, and the rate of penetration of the well into the earth would be substantially increased.

Some have attempted to do this by air drilling. Air drilling is a process which involves the circulation of air through the string of drill pipe. Air drill has met with only modest success. It is perhaps most successful in stone quarries and the like. Air is conducted down the string of drill pipe and out through the drill bit. The air is less effective than drilling mud in maintaining bottom hole pressure blunt it enables all increase in the rate of penetration.

One aspect of successful operation in drilling with air is that increased rate of penetration. Cuttings are blown away but they are not carried as readily through the annular space. They are more readily removed by the column of drilling mud which serves a cleaning and scavenging purpose. The column of return mud is intended to carry all cuttings out of the well borehole and that is normally the case. In addition, the drilling mud cools the drill bit which generates substantial heat as a result of the frictional aspect of the drilling process. In part, this has been dealt with by adding water mist to high pressure air pumped into an air drilling rig. There is some cooling from the water. In addition, it tends to wet the dust which is formed by the drilling and enables an improved return rate with some reduction in dust.

SUMMARY OF THE INVENTION

The present disclosure is directed to a drilling system which uses both drilling mud and air. This enables the system to obtain the benefits of both while yet maintaining safety by providing a continuous column of drilling mud in the annular space. The drilling system allows the mud weight to be adjusted to an underbalanced, an overbalanced, or even a balanced state. The mud density is normally adjusted to drill in an underbalanced state to maximize the rate of penetration of the drill bit. When difficulties are encountered in the drilling process, the weight of the mud column can be adjusted accordingly. As an example, if an abnormally high pressure zone is penetrated by the drill bit, the density of the drilling fluid can be increased to compensate for the increase in bottom hole pressure.

The invention employs a dual drill string, with the outer string consisting of a conventional or typical string of drill pipe assembled as the well is drilled to greater depths and that delivers a flow of drilling mud. On the interior of this conventional string, a spaghetti tubing string delivers air under pressure. Air is supplied from a compressor at the surface to the dual drill string. This spaghetti tubing delivers air which is mixed with drilling mud at a mixing valve which is located downhole in the immediate vicinity of the drill bit. This dilutes the liquid phase of the drilling mud by adding the air, thereby reducing, density of the drilling mud. This enables the system to operate at an underbalanced pressure at the bottom of the well so the rate of drilling can be increased. Alternately, the flow of air through the mixing valve can be decreased or even terminated thereby increasing the density of the mud and creating a balanced or overbalanced drilling environment. The air flow through the mixing valve is therefore varied as needed in order to change the density or "weight" of the drilling mud and hence the balance of the column of mud acting against the formation then being drilled. Moreover, gas flow can be completely terminated for safety sake by completely closing the mixing valve.

The invention deploys one or more sensors or transducers downhole in the vicinity of the drill bit to measure or monitor certain borehole parameters which are indicative of the balance state of the drilling fluid. More specifically, a measure of mud density within the drill stem-borehole annulus in the vicinity of the drill bit, bottom hole pressure, and pressure gradient in the vicinity of the drill bit, and preferably a combination of these parameters, indicate the balance state of the drilling operation. These parameters are preferably used to automatically control the flow of air through the mixing valve thereby maintaining the desired underbalance condition when safe, and immediately shifting to an overbalance condition should, as an example, a sudden change in pressure or pressure gradient be sensed by the downhole sensors. Sensor readings, and the degree of opening of the mixing valve, are simultaneously telemetered to the surface. This information, which cain be expressed with sufficient precision as an eight bit word, is telemetered to the surface by pulsing the mud column within the conventional drill stem-air tubing annulus using mud pulsing techniques well known in the art. Alternately, the data can be telemetered electromagnetically using the air filled spaghetti inner tubing as a waveguide by means of a telemetry disclosed in copending application Ser. No. 08/864,011 filed on May 27, 1997 and assigned to the assignee of the present application, The bottom hole conditions are then monitored by the driller. A second valve is installed in the air tube at the surface in the vicinity of the air compressor. This second valve can be closed by the driller thereby effectively overriding the automatic downhole sensor control of the mixing valve and immediately maximizing the density of the mud. The driller's decision to close the surface valve to maximize mud weight can be based upon readings of the downhole sensors which are telemetered to the surface, or can be based on information obtained from other sources such as experience in drilling the particular area or earth formations. This provides the driller with ultimate override control of the drilling operation which is very desirable and an accepted practice in the drilling industry.

The present system is summarized as a drilling system using a conventional drill string which delivers mud down the drill string and out through the drill bit which is returned in the annular space. The column of mud in the annular space provides pressure compensation to protect against blowouts. This column of mud is diluted intentionally by mixing a controlled rate of air added to the liquid phase of the mud through a downhole mixing valve in the vicinity of the drill hit. The additional air added to the drilling mud can be switched off quickly either automatically based upon downhole measurements, or manually based upon the decision of the driller. However, as long as air is added, the mud density and hence the bottom hole pressure can be changed, thereby enabling most of the drilling to be carried out in an underbalanced condition.

BRIEF DESCRIPTION OF THE DRAWINGS

So that the manner in which the above recited features. advantages and objects of the present invention are attained and can be understood in detail, more particular description of the invention, briefly summarized above, may be had by reference to me embodiments thereof which are illustrated in the appended drawings.

DETAILED DESCRIPTION OF THE PREFERRED EMBODIMENT

Figure 1:
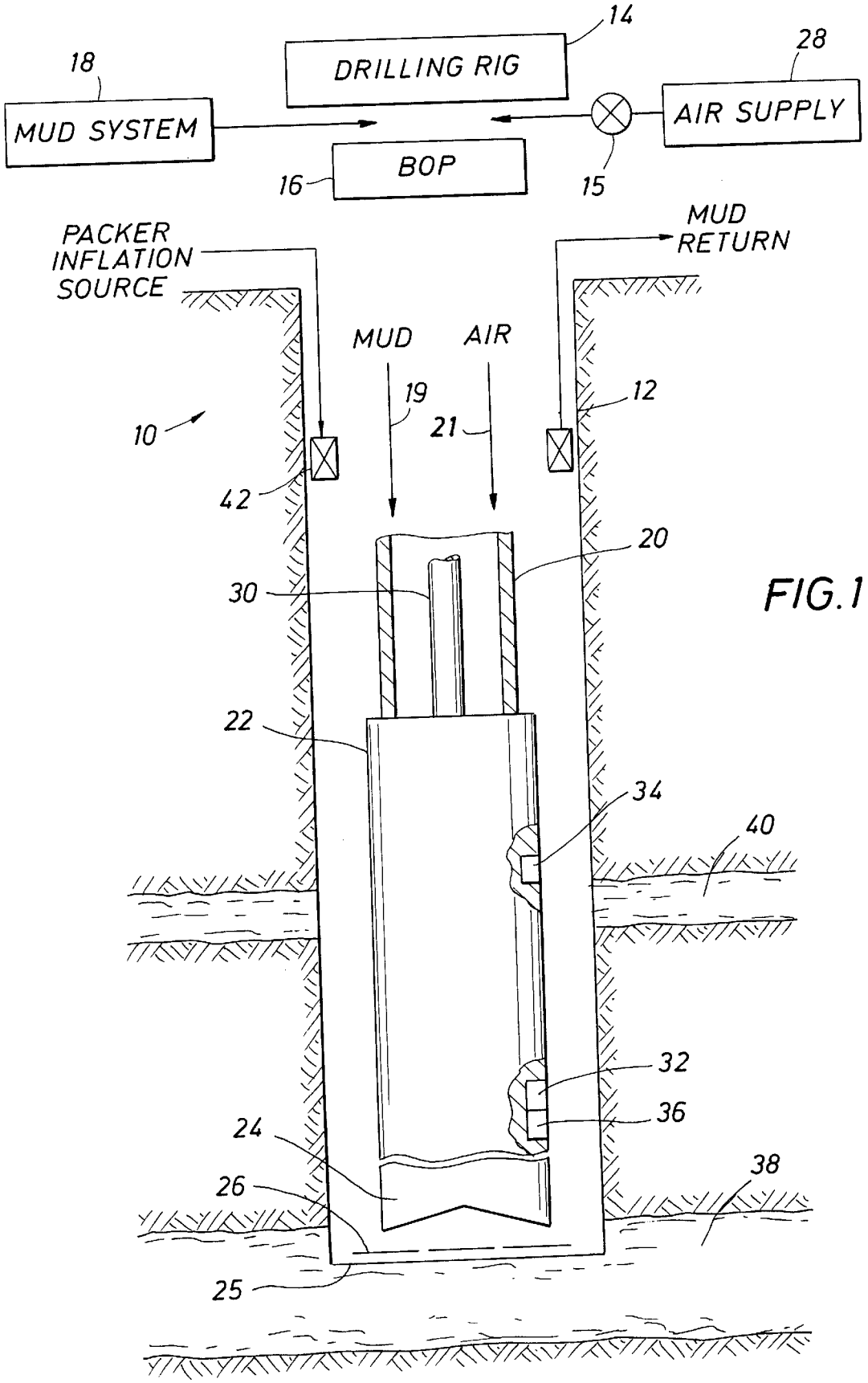
FIG. 1 is a schematic showing the process of drilling a well with a mixed phase system of drilling mud and air input in coaxial pipes in the well borehole, and further discloses an annular return space wherein mud density and bottom hole pressure are measured by detectors in the drill collars above the drill bit.

Attention is now directed to FIG. 1 of the drawings where a drilling system is indicated generally by the numeral 10. This praticular drilling system is formed of conventional drilling components and will be described in detail. After description of the drilling system, the multiphase drilling process of the present disclosure will be given in substantial detail. Examples will be given of typical situations arising when the well borehole penetrates a formation producing either water or gas or some combination. In that instance, there is the risk of a blowout which occurs as result of excessive flow from the well borehole occasioned by penetrating a gas producing formation.

In FIG. 1 of the drawings, the well borehole is generally identified by the numeral 12. At that stage of proceedings, it has a depth which can be several thousand feet deep and is typically not cased. If cased, the surface conductor pipe will extend down a few hundred feet, and the remainder of the well will be open hole. The well is normally fully cased when completion procedures are carried out. At this stage of proceedings, and as set forth in most common situations, the lower portions of the well are open hole which means that the formations penetrated by the well borehole can deliver flowing fluids into the well borehole. Indeed, they can also steal fluids from the well borehole should there be a reduced pressure zone as sometimes occurs.

In any event, assume the well 12 is quite deep. The apparatus shown in FIG. 1 for drilling the well utilizes a drilling rig 14 located at the surface which rig has conventional construction and is used to provide power through the drill stem so the drill bit is rotated. Below the drilling rig, a BOP 16 is usually installed. The BOP 16 is used to prevent loss of well control in the event of a blowout. The typical drilling process utilizes a mud system 18 which provides drilling mud. Mud is pumped down, as indicated by the arrow 19, through the drill pipe 20. The drill string is technically defined as the string of drill pipe plus the drill collars 22 located at the bottom of the drill string. The drill collars are drill pipe having an extra thick wall to provide added stiffness to the lower portions of the well to assure drilling straight holes, and to also provide a controllable weight on bit. The walls are extra thick to increase the weight. It is not uncommon to have between one and ten drill collars, each typically being about thirty feet in length thereby providing up to three or four hundred feet of drill collars above a drill bit 24. The detail of the drill bit 24 has been omitted, and it is shown schematically to clear the area at the bottom of the well 12 for enhanced representation of the drilling process.

A typical drill bit 24 is a drill bit which has three cones (not shown). The cones are equipped with milled steel teeth which are part of the cone, or alternately, they are constructed with a number of holes and extremely hard inserts are placed in the holes. The inserts are typically very hard, made of hard steel, perhaps even made of tungsten carbide particles in a supportive alloy, or even equipped with man-made diamonds or other extremely hard materials. As a generalization, the drill bit teeth are rotated so they punch into the formation, skidding somewhat during rotation, and thereby cutting the face at the bottom of the well. The numeral 25 identifies the bottom hole face, and flakes of the formation material are indicated generally at 26.

Elaborating in some detail, there are several chips 26 shown in FIG. 1 at the hole face 25. These chips are formed by the teeth of the drill bit which cuts the well borehole. So to speak, these chips are held down and do not come up as readily when the pressure is overbalanced. By contrast, when an underbalanced situation occurs, the chips 26 literally explode off the face 25. At that point, the formation pressure aids the drilling process. That cannot happen, however, if the column of drilling mud maintains an overbalanced condition. Therefore, it is desirable that the pressure be underbalanced, but that has to be done at the risk of a blowout situation. The present disclosure sets forth a method and apparatus for obtaining controlled balance in the drilling process.

Continuing with the description of FIG. 1 the drilling system 10 utilizes an air supply 28 which furnishes air, indicated by the arrow 21, through an air conducting pipe or "spaghetti tubing string" 30 which is on the interior of the drill pipe 20. A control valve 15 is positioned in the flow path of air to the spaghetti tubing 30, and is located at the surface preferably in the immediate vicinity of the air supply 28 and within easy access by the driller. The function of this valve will be discussed in a following section. In typical circumstances, the drill pipe is four or five inch drill pipe assembled in thirty foot joints. As the well is drilled deeper, more pipe is added. The air supply 28 is connected with a spaghetti tubing string 30. That typically is provided in longer sections. In some instances, it is provided on a drum or reel which supports several hundred or several thousand feet of the tubing. Typical dimensions are about one inch or slightly greater. The spaghetti tubing string is located on the interior of the drill stem 20. If desired, it can be supported on a set of spaced centralizers. Typically, the spaghetti tubing is put to the drill stem through a swivel so the drill pipe 20 and the spaghetti string 30 are both rotated by the rotary drilling rig 14.

The drill collars 22 are pipe joints with extra thick walls. As shown in FIG. 1 of the drawings, they have been broken away to show wall mounted transducers 32 and 34. These transducers are located at selected locations along the string of drill collars. They will be described in some detail hereinafter. The wall mounted device 32 is a low density detector while the wall mounted device 34 is a high density detector. The terms low and high refer to the physical location. Problems can arise from any number of strata as will be discussed and it is desirable to have one at a minimum and preferably two or three transducers which measure density. More specifically, the low detector 32 is low on the string of drill collars. The high detector 34 is higher in the drill stem. It is possible for a producing strata to begin its flow after some delay, thereby creating a problem which occurs well above the drill bit.

FIG. 1 depicts two of several formations which are penetrated by the well borehole. Assume for purposes of illustration, that the formation being drilled at this depth is a water producing strata 38. Assume also that there is a gas producing strata 40 located thereabove. Between the two, there might be several different strata which have already been drilled and which do not produce anything of significance to the drilling process. In all instances, the well borehole is subject to invasion by fluid from the penetrated strata. Water might enter from the strata 38. If that occurs, it will dilute the drilling mud in the annular space, defined by the outer wall of the drill stem 20 and the inner wall of the borehole 12, to the extent that the water is lighter than the mud. This may reduce the bottom hole pressure within the borehole 12 by dilution. While that is a problem of note, a much greater problem arises from gas which is introduced into the well 12 from the gas strata 40. Assume for purposes of illustration the strata 38 and 40 provide immediate dilution of the mud or delayed dilution. Both will be discussed below.

The drill collar also includes a pressure sensor 36. This sensor provides bottom hole pressure. That measurement is likewise especially important as will be noted in description of the graph of FIG. 3.

Figure 2:
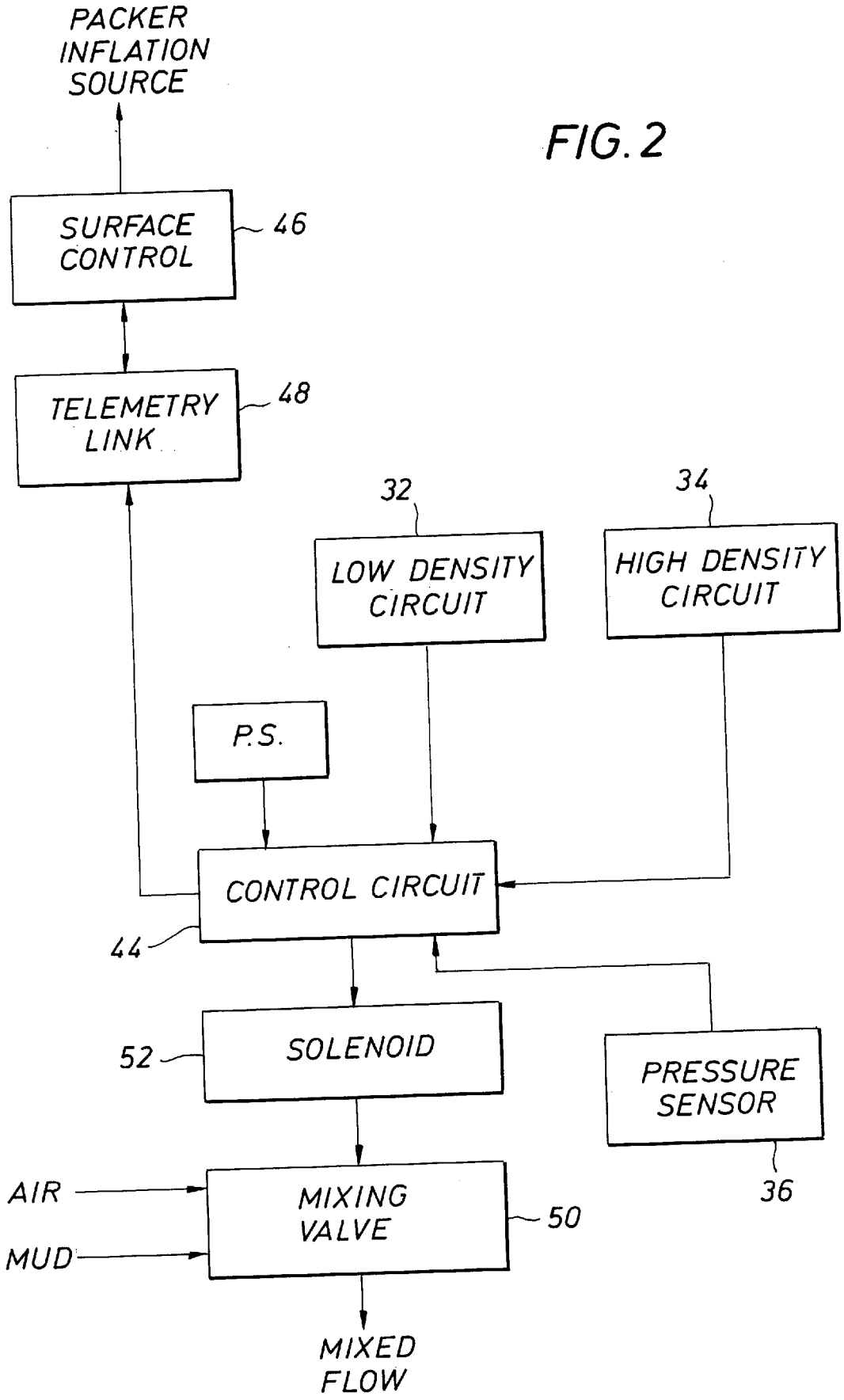
FIG. 2 is a schematic block diagram of the control system used in controlling the mixing valve which mixes air into the drilling mud.

Going now to FIG. 2 of the drawings the measuring devices 32. 34, and 36 are shown in FIG. 2 of the drawings and connect with a control circuit 44. The control circuit is optionally connected with the surface for a surface control system 46. A telemetry system 48 is connected to the surface control and provides an "uplink" communication path from the control circuit 44 and the surface control system 46. The control circuit 44 is normally mounted in the wall of drill collar 22. The control circuit 44 operates a solenoid powered mixing valve 50 which is powered by a solenoid 52. Air and mud are input to the mixing valve 50 and they are proportioned. The mix is directed to the drill bit to form the column of mud in the annular space.

Figure 3:
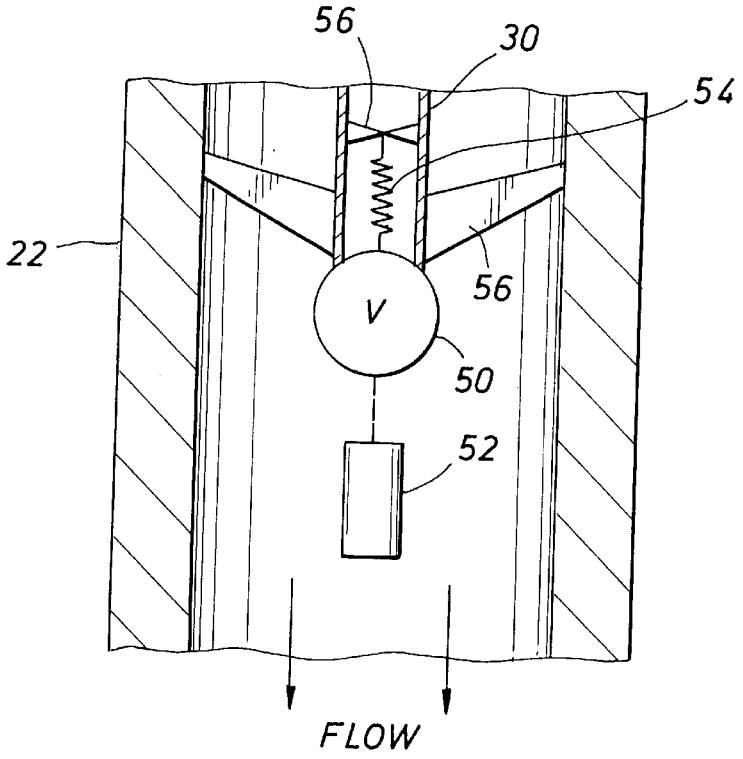
FIG. 3 is a detail of the mixing valve.

Going now to FIG. 3 of the drawings, the tubing string 30 inputs the flow of air to the mixing valve 50. The valve is shown in FIG. 3 connected with the solenoid 52 which pulls the valve open. The solenoid 52 opens or closes the mixing valve 50 to a degree depending upon the magnitude of the signal supplied by the control circuit 44 which, in turn, is driven by the responses of the sensors 32, 34, and 36. As an example, if a relatively sudden increase in bottom hole pressure is indicated by the responses of one or more of the sensors 32, 34, and 36, the control circuit 44 supplies a signal to the solenoid 52 which closes the valve 50 to a degree commensurate with the increase in pressure. The valve 50 is preferably centered in the drill collar 22. There is a bias spring 54 connected to close the vale 50. The spring 54 is supported by a "spider" 56 which is anchored in the end of the spaghetti tubing 30. The spider 56 supports the coil spring 54 so bias is applied which normally closes the valve 50. The tubing string 30 is supported on a set of mounting vanes or spider 56 which number two or three and which centralize the lower end of the spaghetti tubing 30 in the drill collar. Recall the pipe string, 20 and tubing string 30 rotate together and therefore there is no relative motion between these components. It is desirable that the tubing 30 be relative small so it does not impede the flow of drilling mLud. Moreover, in the event of a system failure, the valve 50 is preferably biased so it is closed, not opened. This assures that failure moves the equipment to a safe condition, namely, the mud in the annular space is at the maximum density. In other words, it is not diluted with air.

Consider as an example a deep well which is drilled over a number of days. This is exemplified in FIG. 4 of the drawings which is a graph showing bottom hole pressure as a function of depth within the borehole 12. This ignores for the moment any formations which have increased pressures because the formations confine natural gas, water, oil or any mixture thereof. The curve 60 is the typical increase of bottom hole pressure as a function of depth. Essentially, the curve 60 depicts a linear increase in pressure as a function of depth. It is dependent primarily on the density of the earth which is substantially fixed. Moreover, in drilling the well 12 and adhering to common practices, the bottom hole pressure defined by curve 60 sets out a minimum 1 maintained in the ordinary procedure. An overbalanced condition is normally achieved by increasing the density of the drilling mud. The overbalanced operation is identified by the line segment 62. This describes drilling conducted with a pressure at the bottom which is greater than the pressure in the formations penetrated at that particular depth.

Drilling in the overbalanced condition causes the drilling rate to decrease below what could otherwise normally be achieved. A representative drilling rate is shown by the line segment 64. Assume for purposes of description the bottom hole pressure is changed to an underbalanced condition as represented by segment 66. When that happens, the drilling rate increases to the drilling rate 68 shown in FIG. 4. In this particular instance, assume the under pressure condition is about 50 psi. It is not uncommon for the drilling rate to increase 10%, or perhaps even 20% or 25%, by shifting from an overbalanced condition of 100 psi, a common target pressure, to an underbalanced condition of 50 psi below balance.

Figure 4:
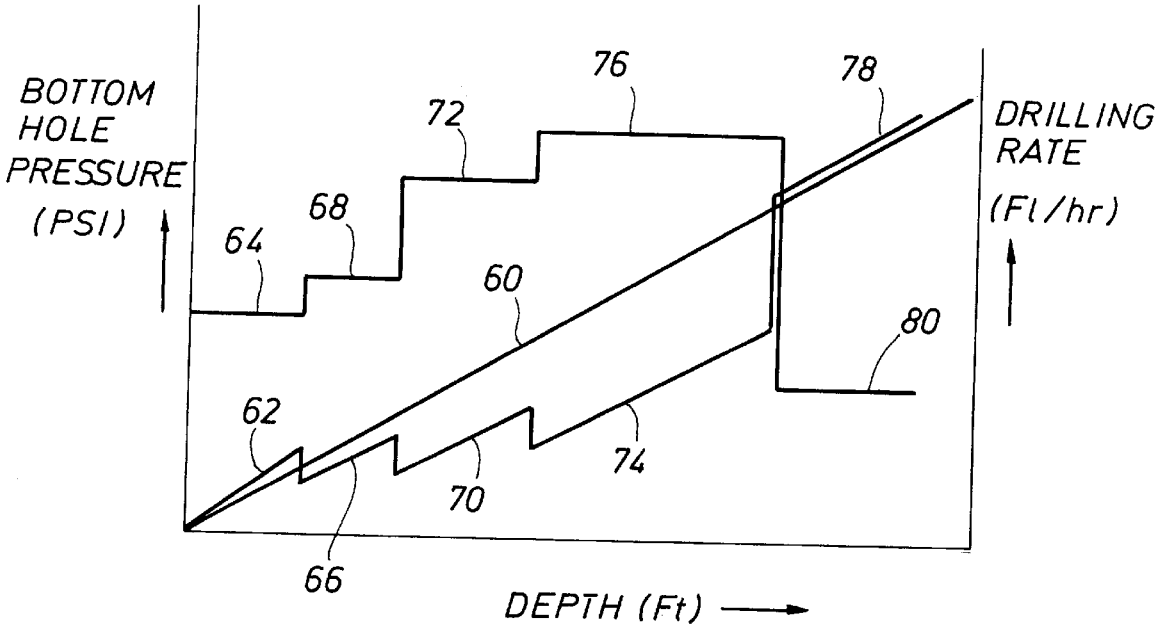
FIG. 4 is a graph showing bottom hole pressure as a function of depth wherein adjustments are made in bottom hole pressure to shift from an overbalanced to an underbalanced condition to increase penetration.

FIG. 4 shows drilling at a further reduced under pressure condition. Line segment 70 represents an under pressure condition of about 100 psi. In other words, the spacing between the line segment 70 and the balanced pressure condition represented by line 60 is about 100 psi. In this condition, the drilling rate 72 goes up even more, and is perhaps an increase as much as 40% over the drilling rate 64. Assume the bottom hole pressure can be reduced to 150 psi below balanced pressure.

This is represented by curve or segment 74. In other words, line segment 74 shows an under pressure condition compared with the curve 60. In that instance, the drilling rate might increase even more to the rate 76. As will be seen to this juncture, with greater reductions below the balance pressure, the drilling rate is increased.

Assume for purposes of discussion that the strata 38 in FIG. 1 produces water. That does not significantly impact the density or "quality" of the mud. A more serious condition, however, can be achieved if the strata 40 produces a quantity of gas into the annular space between the drill stem 20 and the wall of the borehole 12. This seriously cuts the density or quality of the drilling mud. The position of the sensors 32 and 34 should be noted with respect to strata 40. When a strata is first punctured by the well borehole, natural gas may flow. On the other hand, it may take some time. Typically, when a layer of mud, sometimes known as mud cake, is built up on the sidewall of the hole, it temporarily seals off the formation 40 from producing. The mud cake is formed by the drilling mud. The drilling mud normally includes heavier particles which are clay products. The solvent is normally water. The water may flow into the formation 40, thereby leaving a deposition on the borehole wall of the heavier mud cake particles. The mud cake can be damaged either by scraping while tripping the drill stem, or it can be damaged by washing with water. Whatever the case, formation 40 may immediately produce natural gas when penetrated or may provide natural gas later. Suffice it to say, whenever formation 40 introduces natural gas into the annual space, dilution of the mud occurs thereby reducing mud density. In the examples shown in FIG. 1, changes in mud density may occur so the density is reduced or alternately bottom hole pressure within the borehole 12 is reduced. In the particular example used, bottom hole conditions are detected by transducers 32, 34 and 36. In fact, several mud density transducers can be positioned on the drill collars to measure the density of the mud in the annular space. Mud density measurements are readily obtained by devices well known in the art. In addition, bottom hole pressure is measured by a pressure transducer.

The outputs of the sensors provide data for the control circuit 44. The control circuit 44 adjusts the solenoid 52 by providing more or less electrical power from the power supply for operation of the solenoid. In turn, that opens to add more air to the mud, or closes to reduce added air. Air, when added, reduces the mud density so the underbalanced condition is obtained.

Assume that one of the sensors 32, 34 or 36 detects an indication that the mud density is dangerously light. Assume this occurs as a result of dilution of the mud in the annular return space. In that particular instance, the control circuit 44 closes the mixing valve 50. So to speak, closure can be accomplished simply by removing electrical power from solenoid 52. The return spring 54 automatically operates to close the valve 50.

Going now to FIG. 4 of the drawings, the line segment 78 shows continued drilling at an overbalanced condition. This drops the rate of penetration to the lower rate 80. While the rate of penetration is reduced, safety is assured by the dynamic operation of the mixing valve to achieve the change in density. For instance, if no air is mixed with the liquid phase of the mud, the density of the mud is increased. The mud system 18 shown in FIG. 1 is operated to provide mud of a specified density. The overbalanced drilling can continue as indicated by the line segment 78. This portion of the curve continues until the threat posed by dilution of the mud is safely handled.

Going back now to FIGS. 1 and 2 of the drawings, the surface control 46 receives borehole conditions measured by the sensors 32, 34 and 36. The driller can monitor these measurements for abnormal borehole conditions such as overpressured zones. Based upon the driller's decision, the mud weight can be maximized for any reason whatsoever by closing the valve 15. This effectively allows the driller to override the automated control of the mixing valve 50 based upon downhole sensor or transducer readings. Alternately, a "downhole" link can be provided in the telemetry link 48 whereby the driller override the automated control of the valve 50 and can telemeter commands to the control circuit 44 to close valve 50 by means of the solenoid 52. If desired, for any reason whatsoever, valve 50 is closed so air is no longer delivered.

Again assume that one of the sensors 32, 34 or 36 detects an indication that the mud density is dangerously low. The system can be embodied to automatically operate a packer 42 which is expanded or retracted in the borehole 12 on the exterior of the drill stem 20, where the packer is set sufficiently deep to block flow of fluids to the surface of the earth. Alternately, the system can be configured to automatically activate the BOP 16. It should also be understood that the driller can activate the packer or the BOP manually based upon responses of the sensors 32, 34 or 36.

The mud supply system 18 and air supply 28 at the surface must be operated at pressures appropriate for operation. As will be understood, the pressure at the valve 50 in the column of drilling mud is determined primarily by depth. In other words, mud is a standing column of water, and is heavier dependent on the amount of clay added to the water. That pressure can be measured and indicated by the bottom hole pressure transducer 36. As discussed previously, that data can be furnished by means of the uplink of telemetry link 48. That provides a target pressure for the air supply 28. As will be understood, the water in the annular space and in the drill pipe 20 is substantially incompressible. By contrast, the air in the spaghetti tubing 30 is very compressible. For that reason, it may be necessary to increase the rate of pumping to thereby increase the pressure at the valve 50. It is desirable that pressure in the air line exceed the bottom hole pressure so air is delivered through the valve 50. Otherwise, if that pressure were low, the valve 50 would permit mud to flow back into the tubing string 30. Because of that, air pressure in spaghetti tubing 30 is maintained in an overbalanced pressure, typically being overbalanced by 100–300 psi. As will be understood that is a variable dependent upon depth. In other words, as the well becomes deeper, air pressure must be increased to something above the curve 60 shown in FIG. 4 so air is delivered through the valve. Otherwise, the valve 50 will have to include a check valve.

While the foregoing is directed to the foregoing embodiment the scope is determined by the claims which follow.

What is claimed is:

1. A method of drilling a well comprising the steps of:

(a) drilling a well with a drill bit on a drill stem;

(b) conducting drilling fluid through the drill bit to flow upwardly in the drilled well around the drill stem;

(c) conducting a gas flow down a gas flow line into the well to mix in the drilling fluid to reduce drilling fluid density;

(d) measuring properties of the drilling fluid flowing upwardly in the well to measure blowout indications; and (e) changing the gas within the drilling fluid in response to drilling fluid measurements to suppress an indicated blowout.

2. The method of claim 1 including the step of initially installing a drilling fluid and gas mixing valve in the drill stem wherein the gas is added to reduce the drilled well pressure at a formation being drilled by the drill bit so that the drilling process is underbalanced by a specified pressure.

3. The method of claim 1 including the step of positioning a gas conductor on the interior of the drill stem and connecting the gas conductor with a mixing valve in the drill stem so that gas is mixed in the drilling fluid prior to flowing through the drill bit.

4. The method of claim 1 wherein the step of measuring properties of the drilling fluid comprises measuring the density of the drilling fluid in the drilled well, and the measurement is repeated by measuring at specified depths.

5. The method of claim 4 wherein the step of measuring the density of the drilling fluid in the drilled well is repeated by measuring density at specified locations along the drill stem.

6. The method of claim 1 wherein the step of measuring properties of the drilling fluid in the drilled well comprises the step of measured density or pressure at multiple depths.

7. The method of claim 1 including the step of mixing the gas flow with the drilling fluid at the drill hit.

8. The method of claim 7 including the step of providing the gas flow line inside the drill stem.

9. The method of claim 1 including the step of forming a drill stem of at least one joint of drill pipe at least one drill collar and the drill bit connected below the drill collar and further including the step of installing a drilling fluid mixing valve for mixing the gas into the drilling fluid above the drill bit.

10. A method of controlling the drilling process for drilling a well using drilling mud which is pumped down the partially drilled well through a drill stem connected with a drill bit wherein the method comprises the steps of:

(a) drilling the well with said drill bit on the drill stem wherein a column of drilling mud is maintained in the partially drilled well and a bottom hole pressure of a column of drilling mud is periodically adjusted by adjusting downhole a density of the drilling mud by controllably mixing air with said drilling mud;

(b) measuring a pressure created by the column of drilling mud in the partially drilled well; and (c) controllably reducing the pressure of the column of drilling mud in the partially drilled well at the bottom thereof so the column of drilling mud is varied with respect to the pressure of the formations penetrated by the drilled well.

11. The method of claim 10 wherein the pressure of the column of drilling mud is measured near the bottom of the well during drilling, and the pressure is reduced so that an underbalanced condition is maintained.

12. The method of claim 10 including the step of preventing a blowout through the partially drilled well by controllably operating a packer which is expanded or retracted in the well on the exterior of a drill stem supporting a drill bit in the well and the picker is set in the well sufficiently deep that the packer blocks flow to the surface of the well.

13. The method of claim 11 wherein the step of reducing mud pressure at the bottom increases drill bit penetration and is continued in the underbalanced condition until a formation is penetrated that flows gas into the well at a higher pressure than the pressure maintained in the well.

14. The method of claim 13 including the step of measuring conditions along the well drilling mud to obtain an indication that the penetrated formation flows into the well and thereby reduces the drilling mud density sufficiently to pose a threat that well control may be lost.

15. The method of claim 14 including the ongoing step of mixing a gas from the surface in the drilling mud to reduce mud density and reducing the gas mixed in the drilling mud to raise drilling mud density to overcome threatened well control loss.

16. The method of claim 15 wherein the drilling mud density is measured at two or more depths in the well.

17. The method of claim 16 including the emergency step of shutting in the well to maintain well control.

18. A method of preventing at blowout while drilling a well wherein blowout control is obtained by forming a standing column of drilling fluid in the well to prevent blowouts and the method comprises:

(a) filling the drilled well with a standing column of drilling mud having a specified bottom hole pressure;

(b) during drilling and at a location within the well, changing density of the drilling mud by controllably mixing air with said drilling mud thereby reducing bottom hole drilling fluid pressure to an underbalanced condition to expedite drilling;

(c) continuing drilling until formation driven fluid causes a change in well conditions as a precursor to a blowout;

(d) measuring the condition of the column of drilling mud in the drilled well to detect changes in conditions indicative of a blowout;

(e) transmitting drilling mud conditions along the well to the surface; and (f) controlling the well in the event measured downhole mud conditions indicate a blowout precursor condition has occurred.

19. The method of claim 18 including the step of measuring drilling mud conditions including drilling mud density to detect mud density reduction resultant from formation fluid, and then changing to an overbalanced condition in the well.

20. A method of preventing a blowout while drilling a well wherein blowout control is obtained by forming a standing column of drilling fluid in the well to prevent blowouts and the method comprises:

(a) filling the drilled well with a standing column of drilling mud having a specified bottom hole pressure;

(b) during drilling and at a location within the well, changing density of the drilling mud thereby reducing bottom hole drilling fluid pressure to an underbalanced condition to expedite drilling;

(c) continuing drilling until formation driven fluid causes a change in well conditions as a precursor to a blowout;

(d) measuring the condition of the column of drilling mud in the drilled well to detect changes in conditions indicative of a blowout;

(e) transmitting drilling mud conditions along the well to the surface; and (f) controlling the well in the event measured downhole mud conditions indicate a blowout precursor condition has occurred, wherein the drilling mud is initially gas cut to reduce mud pressure for an underbalanced condition, and the gas cut pressure reduction is stopped to counter blowout precursor conditions.

21. The method of claim 20 including the step of measuring drilling mud pressure and maintaining bottom pressure below the formation pressure for drilling until blowout precursor conditions have occurred.

22. The method of claim 21 wherein bottom hole pressure increases with depth and is maintained underbalanced until blowout precursor conditions have occurred, and then preventing a blowout by raising drilling mud pressure.

23. An apparatus for drilling a well comprising:

(a) a drill string comprising a drill pipe through which drilling fluid is pumped and an inner conduit through which air is pumped;

(b) a drill collar supported by said drill string within said well, wherein said drill collar comprises one or more sensors; and (c) a valve within said drill collar which is operated to control the mixing of said pumped drilling fluid and said pumped air within said drill collar.

24. The apparatus of claim 23 wherein said valve is operated based upon response of said one or more sensors.

25. The apparatus of claim 24 wherein said valve is operated automatically based upon response of said one or more sensors.

26. The apparatus of claim 23 wherein said valve is operated so that said control mixing:

(a) maintains bottom hole pressure at an underbalanced condition so drilling rate is enhanced; and (c) controllably increases bottom hole pressure to prevent a blowout through the well in the event a change in pressure, as measured by said one or more sensors, is indicative of a blowout.

27. The apparatus of claim 23 further comprising:

(a) said one or more sensors for detecting excessive gas inflow into said well from a formation; and (b) means for operating a packer to pack off the well based upon response of said one or more sensors.

28. The apparatus of claim 23 wherein said valve is operated by actions taken at the surface of the earth.

29. A method of controlling the drilling process for drilling a well using drilling mud which is pumped down the partially drilled well through a drill stem connected with a drill bit wherein the method comprises the steps of:

(a) drilling the well with a drill bit on the drill stem wherein a column of drilling mud is maintained in the partially drilled well and the bottom hole pressure of the column of drilling mud is periodically adjusted by adjusting downhole the density of the drilling mud;

(b) measuring the pressure created by the column of drilling mud in the partially drilled well;

(c) controllably reducing the pressure of the column of drilling mud in the partially drilled well at the bottom thereof so the column of drilling mud is varied with respect to the pressure of the formations penetrated by the drilled well, wherein the pressure of the column of drilling mud is measured near the bottom of the well during drilling, and the pressure is reduced so that an underbalanced condition is maintained; and (d) pumping drilling mud having a density greater than required into the well and reducing drilling mud density with air mixed in the drilling mud.

30. The method of claim 29 wherein air is mixed in the drilling mud near the bottom of the well.

31. The method of claim 29 including the step of preventing a blowout through the partially drilled well by controllably operating a packer which is expanded or retracted in the well on the exterior of a drill stem supporting a drill bit in the well and the packer is set in the well sufficiently deep that the packer blocks flow to the surface of the well.

32. The method of claim 29 wherein the step of reducing mud pressure at the bottom increases drill bit penetration and is continued in the underbalanced condition until a formation is penetrated that flows gas into the well at a higher pressure than the pressure maintained in the well.

33. The method of claim 32 including the step of measuring conditions along the well drilling mud to obtain an indication that the penetrated formation flows into the well and thereby reduces the drilling mud density sufficiently to pose a threat that well control may be lost.

34. The method of claim 33 including the ongoing step of mixing a gas from the surface in the drilling mud to reduce mud density and reducing the gas mixed in the drilling mud to raise drilling mud density to overcome threatened well control loss.

35. The method of claim 34 wherein the drilling mud density is measured at two or more depths in the well.

36. The method of claim 35 including the emergency step of shutting in the well to maintain well control.

* * * * *